US010909941B2

(12) United States Patent
An et al.

(10) Patent No.: US 10,909,941 B2
(45) Date of Patent: Feb. 2, 2021

(54) LIQUID CRYSTAL DISPLAY DEVICE HAVING A TIMING CONTROLLER FOR REDUCING CROSSTALK DEFECT AND DRIVING METHOD THEREOF

(71) Applicant: Samsung Display Co., LTD., Yongin-si (KR)

(72) Inventors: Taehyeong An, Hwaseong-si (KR); KyoungHo Lim, Suwon-si (KR); Soo-Yeon Lee, Hwaseong-si (KR); Jaehoon Lee, Seoul (KR); Nam-Gon Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/235,048

(22) Filed: Dec. 28, 2018

(65) Prior Publication Data

US 2019/0206349 A1 Jul. 4, 2019

(30) Foreign Application Priority Data

Jan. 4, 2018 (KR) ..... 10-2018-0001360

(51) Int. Cl.
*G09G 3/36* (2006.01)

(52) U.S. Cl.
CPC ..... *G09G 3/3648* (2013.01); *G09G 3/3674* (2013.01); *G09G 3/3685* (2013.01); *G09G 2310/08* (2013.01); *G09G 2330/021* (2013.01)

(58) Field of Classification Search
CPC ..... G09G 3/3648
USPC ..... 345/691
See application file for complete search history.

(56) References Cited

U.S. PATENT DOCUMENTS

2011/0292099 A1* 12/2011 Kim ..... G09G 3/3614 345/691
2015/0302812 A1* 10/2015 Jeong ..... G09G 3/3614 345/209
2017/0069278 A1* 3/2017 Kim ..... G09G 3/3614
2017/0084249 A1* 3/2017 Kim ..... G09G 3/3688

FOREIGN PATENT DOCUMENTS

KR 10-2015-0120589 A 10/2015

* cited by examiner

*Primary Examiner* — Long D Pham
(74) *Attorney, Agent, or Firm* — Lewis Roca Rothgerber Christie LLP

(57) ABSTRACT

A liquid crystal display device and a driving method of the liquid crystal display device includes a display panel including a plurality of gate lines, a plurality of data lines crossing the gate lines, and a plurality of pixels coupled to the gate lines and the data lines, a gate driver configured to provide a gate signal to the pixels through the gate lines, a data driver configured to provide a data signal to the pixels through the data lines and a timing controller configured to receive an image data provided from an external device and generate control signals that control the gate driver and the data driver. The timing controller analyzes a pattern of the image data by every frame, and changes an inversion driving method and gamma voltages of the image data based on a pattern analyzing result from the analysis of the pattern of the image data.

20 Claims, 11 Drawing Sheets

LIQUID CRYSTAL DISPLAY DEVICE HAVING A TIMING CONTROLLER FOR REDUCING CROSSTALK DEFECT AND DRIVING METHOD THEREOF

CROSS-REFERENCE TO RELATED APPLICATION

This application claims priority to and the benefit of Korean Patent Application No. 10-2018-0001360, filed on Jan. 4, 2018 in the Korean Intellectual Property Office (KIPO), the content of which is incorporated herein in its entirety by reference.

BACKGROUND

1. Field

Example embodiments relate generally to a liquid crystal display device and a driving method of the same.

2. Description of the Related Art

In a liquid crystal display device, the arrangement of liquid crystal molecules may be changed by forming an electric field across a liquid crystal layer disposed between two substrates. The transmissivity of incident light may be adjusted due to variations in the arrangement of the liquid crystal molecules, thereby displaying images.

Based on a phase of a data voltage applied to a data line, a method of driving a liquid crystal display device may be classified as line inversion, column inversion, or dot inversion. In line inversion, a phase of the image data being applied to a data line may be inverted every pixel column. In column inversion, a phase of the image data being applied to a data line may be inverted every pixel column. In dot inversion, a phase of the image data being applied to a data line may be inverted every pixel row and every pixel column.

Recently, a pattern detect function (PDF) that detects a pattern of an image data that causes a crosstalk or flicker and improve the crosstalk or the flicker by changing the inversion method is studied.

The above information disclosed in this Background section is only for enhancement of understanding of the background of the invention and therefore it may contain information that does not constitute prior art.

SUMMARY

Some aspects of example embodiments provide a liquid crystal display device capable of improving display quality.

Some aspects of example embodiments provide a driving method of a liquid crystal device capable of improving display quality.

According to an example embodiment, a liquid crystal display device may include a display panel including a plurality of gate lines, a plurality of data lines crossing the gate lines, a plurality of pixels coupled to the gate lines and the data lines, a gate driver configured to provide a gate signal to the pixels through the gate lines, a data driver configured to provide a data signal to the pixels through the data lines, and a timing controller configured to receive an image data provided from an external device and generate control signals that control the gate driver and the data driver. The timing controller of the liquid crystal display device may analyze a pattern of the image data by every frame, and change an inversion driving method and gamma voltages of the image data based on a pattern analyzing result from the analysis of the pattern of the image data.

In an example embodiment, the timing controller of the liquid crystal display device may include a first detector configured to determine whether the image data includes a set or predetermined crosstalk pattern, a second detector configured to determine whether polarities of on-pixels that turn on corresponding to the image data are unequally distributed when the image data include the crosstalk pattern, an inversion driving controller configured to change the inversion driving method of the image data when the polarities of the on-pixels are unequally distributed and a gamma controller configured to output the gamma control signal that symmetrically changes positive gamma voltages and negative gamma voltages generated from the data driver when the polarities of the on-pixels are equally distributed.

In an example embodiment, the first detector may determine whether the image data includes the crosstalk pattern based on a size, a shape, and a grayscale value of the pattern of the image data.

In an example embodiment, the second detector may analyze the image data by every line data.

In an example embodiment, the second detector may detect a data area in which the polarities are unequally distributed and provides the data area to the inversion driving controller. In an example embodiment, the inversion driving controller may change the inversion driving method of the line data that includes the data area.

In an example embodiment, the liquid crystal display device may further include a power controller configured to generate a voltage provided to the display panel and the data driver. In an example embodiment, the gamma controller may be coupled to the power controller, and output the gamma control signal that changes a reference gamma voltage generated from the power controller.

In an example embodiment, the power controller may include a digital variable resistor, and change the reference gamma voltage by changing a resistor value of the digital variable resistor based on the gamma control signal.

In an example embodiment, the data driver may generate the positive polarity gamma voltages and the negative polarity gamma voltages that are symmetric based on the reference gamma voltage.

In an example embodiment, the timing controller may include a plurality of gamma data sets that determines a gamma voltage of the data driver. In an example embodiment, the gamma controller may output a gamma control signal that changes the gamma data set provided to the data driver.

In an example embodiment, the timing controller may store the gamma data sets as a lookup table (LUT).

In an example embodiment, the data driver may generate the positive polarity gamma voltages and the negative polarity gamma voltages that are symmetric based on the gamma data set.

In an example embodiment, the crosstalk pattern may be a pattern that causes a crosstalk defect when the crosstalk pattern is displayed on the display panel.

According to an example embodiment, a driving method of a liquid crystal display device may include determining whether the image data provided from an external device includes a set or predetermined crosstalk pattern, determining whether polarities of on-pixels that turn on corresponding to the image data are unequally distributed when the image data includes the crosstalk pattern, changing an inversion driving method of the image data when the polarities of the on-pixels are unequally distributed, and changing gamma voltages of the image data when the polarities of the on-pixels are equally distributed.

In an example embodiment, the crosstalk pattern may be determined based on a size, a shape, and a grayscale value of pattern of the image data.

In an example embodiment, the image data may be analyzed by every line data.

In an example embodiment, a distribution of the polarities of the on-pixels may be determined by detecting a data area in which the polarity of the on-pixels are unequally distributed, and the inversion driving method of the image data may be changed by changing the inversion driving method of the line data that includes the data area that is changed.

In an example embodiment, the inversion driving method of the image data may be changed by changing the inversion driving method of all image data.

In an example embodiment, gamma voltages of the image data may be changed by changing a reference gamma voltage.

In an example embodiment, gamma voltages of the image data may be changed by changing a gamma data set.

In an example embodiment, the driving method of the liquid crystal display device may further include generating the gamma voltages of which positive gamma voltages and negative gamma voltages are symmetric.

Therefore, in some example embodiments, the liquid crystal display device and the driving method of the same may prevent or reduce crosstalk defect by changing the inversion driving method so that the polarities of the on-pixels are equally distributed and changing the gamma voltages of which the positive gamma voltages and the negative gamma voltage to be symmetric. Further, in some example embodiments, the liquid crystal display device and the driving method of the same may prevent or reduce an image sticking of the display panel by changing the gamma voltages of which the positive gamma voltages and the negative gamma voltage to be symmetric when the image data includes the crosstalk pattern and maintaining the gamma voltages of which the positive gamma voltages and the negative gamma voltage to be asymmetric when the image data does not include the crosstalk pattern.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

The detailed description set forth below in connection with the appended drawings is intended as a description of some example embodiments of a liquid crystal display device and a driving method of the same provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the scope of the invention. As denoted elsewhere herein, like element numbers are intended to indicate like elements or features.

Hereinafter, example embodiments of the present disclosure will be explained in more detail with reference to the accompanying drawings.

Figure 1:
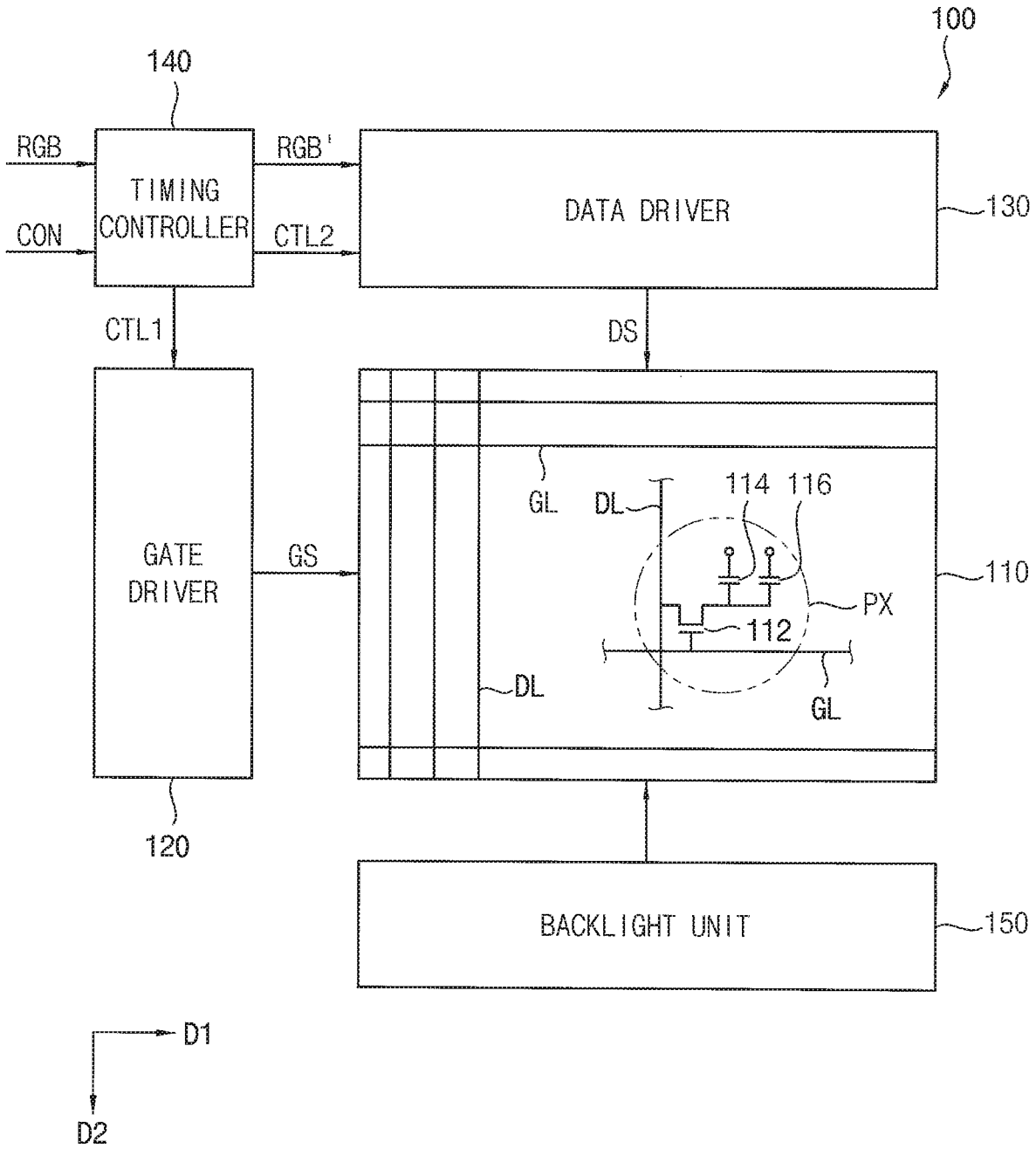
FIG. 1 is a block diagram illustrating a liquid display device according to an example embodiment.
Figure 2:
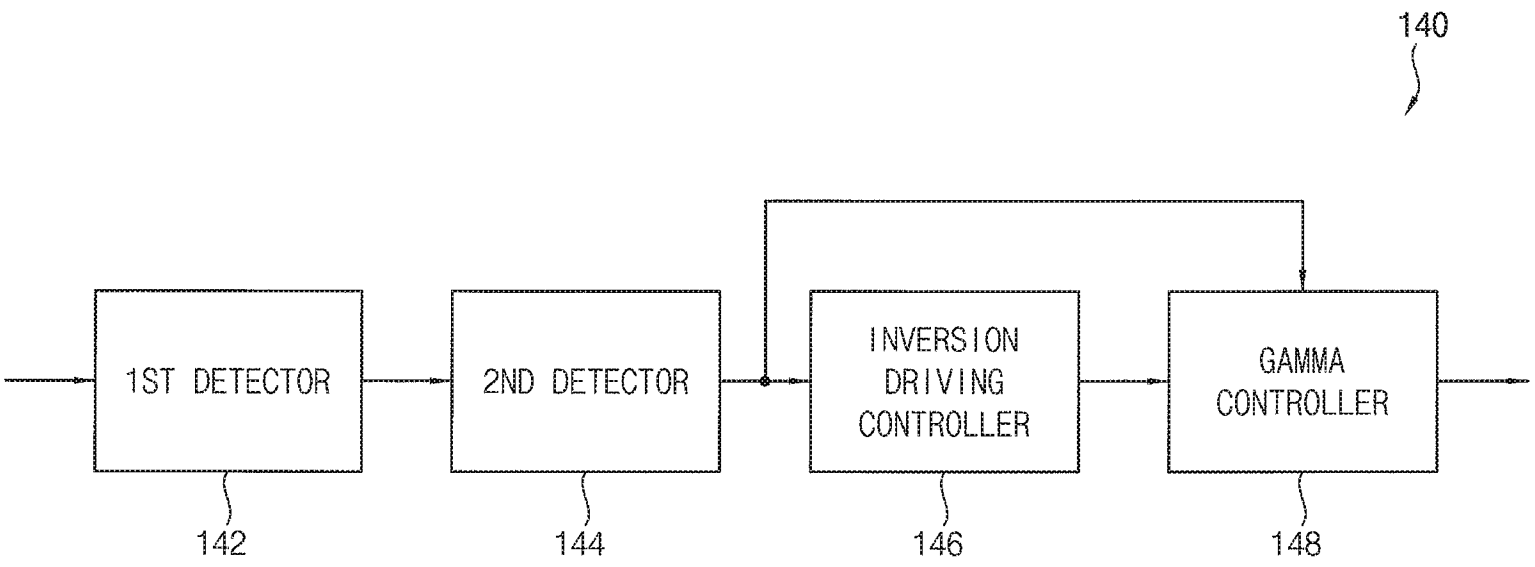
FIG. 2 is a diagram illustrating a timing controller included in the liquid crystal display device of FIG. 1.
Figure 3A:
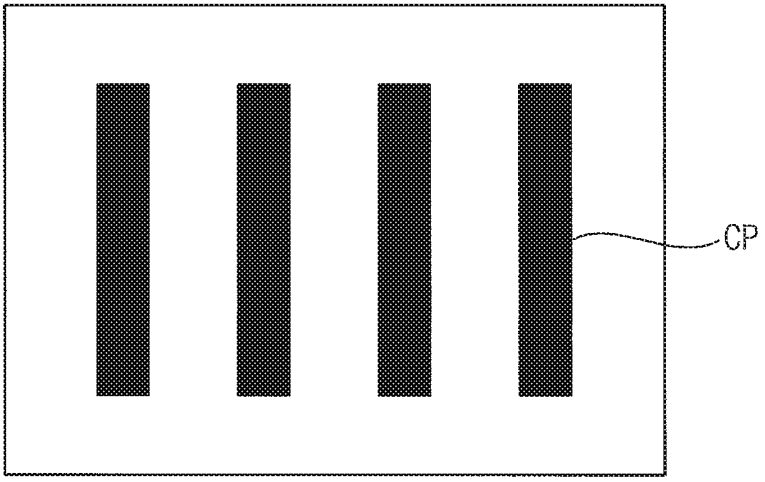
FIGS. 3A and 3B are diagrams illustrating an example operation of a first detector included in the timing controller of FIG. 2.
Figure 3B:
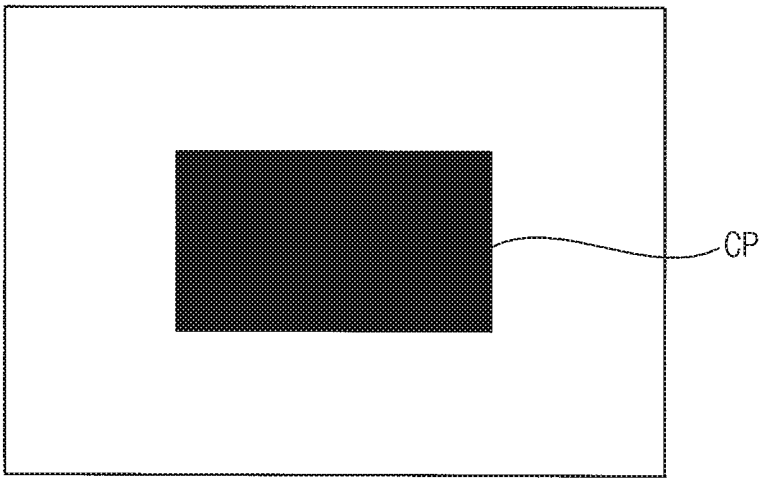

FIG. 1 is a block diagram illustrating a liquid crystal display device, according to an example embodiment. FIG. 2 is a diagram illustrating an example embodiment of a timing controller included in the liquid crystal display device of FIG. 1. FIGS. 3A and 3B are diagrams illustrating an example operation of a first detector included in the timing controller of FIG. 2.

Referring to FIG. 1, a liquid crystal display device 100 may include a liquid crystal display panel 110, a gate driver 120, a data driver 130, and a timing controller 140. The liquid crystal display device 100 may further include a backlight unit 150 that may provide light to the liquid crystal display panel 110.

The liquid crystal display panel 110 may include a plurality of data lines DL, a plurality of gate lines GL, and a plurality of pixels PX. The gate lines GL may extend in a first direction D1 and may be arranged with each other in a second direction D2 crossing (e.g., substantially perpendicular to) the first direction D1. The data lines DL may extend in the second direction D2 and may be arranged with each other in the first direction D1. The first direction D1 may be parallel with a long side of the display panel 110, and the second direction D2 may be parallel with the short side of the display panel 110. Each pixel PX of the plurality of pixels may be located in a crossing or intersection region of the data line DL and the gate line GL. Each of the pixels may include a thin film transistor 112 electrically coupled to the gate line GL and the data line DL, a liquid crystal capacitor 114, and a storage capacitor 116 coupled to the thin film transistor 112.

The timing controller 140 may receive an image data RGB and a control signal CON from an external device. For example, the external device may be a graphic processor. The timing controller 140 may output an image data RGB' by selectively performing a display quality compensation, an adaptive color correction (ACC), and/or a dynamic capacitance compensation (DCC), and/or the like, to an image data RGB. Alternatively, the timing controller 140 may provide the original image data RGB provided from the external device to the data driver 130 without any further processing. The control signal CON may include a horizontal synchronization signal, a vertical synchronization signal, clock signals, etc. The timing controller 140 may generate a horizontal start signal using the horizontal synchronization signal. The timing controller 140 may generate a vertical start signal using the vertical synchronization signal. The timing controller 140 may generate a first clock signal and a second clock signal using the clock signals. The timing controller 140 may provide the vertical start signal and the first clock signal to the gate driver 120 as a first control signal CTL1. The timing controller 140 may provide the vertical start signal and a second clock signal to the data driver 130 as the second control signal CTL2.

The gate driver 120 may generate a gate signal GS based on the first control signal CTL1 provided from the timing controller 140. The gate driver 120 may generate the gate signal GS in response to the vertical start signal and the first clock signal, and may output the gate signal GS to the gate line GL.

The data driver 130 may generate gamma voltages based on a reference voltage provided from a power management integrated circuit (PMIC) and a gamma data set provided from the timing controller 140. The data driver 130 may output the data signal DS in response to the second control signal CTL2 provided form the timing controller 140. The data driver 130 may output the gamma voltage corresponding to the image data RGB' in response to the horizontal start signal and the second clock signal as the data signal DS to the data line DL.

The timing controller 140 may analyze a pattern of the image data RGB by every frame and change an inversion driving method and the gamma voltages of the image data RGB based on a pattern analyzing result from the analysis of the pattern of the image data RGB.

On-pixels that turn on corresponding to the image data RGB, may have a positive polarity (+) and a negative polarity (−) according to the inversion driving method. A crosstalk defect may occur when the on-pixels having the positive polarity and the on-pixels having the negative polarity are unequally distributed. In this case, the crosstalk defect may be reduced by changing the inversion driving method and equally distributing the on-pixels with the positive polarity and the on-pixels with the negative polarity.

Further, a positive gamma voltage and a negative gamma voltage may be unsymmetrically set based on a kickback voltage to reduce an image sticking of the liquid crystal display panel 110. That is, when the data signal (i.e., the data voltage) provided to the pixel is rapidly changed, ripple may occur on a common voltage because of the unsymmetrical gamma voltage. Then, the crosstalk defect by the ripple occurs as the liquid crystal display device 100 is driven in a high-frequency. Thus, the crosstalk defect may occur by the unsymmetrical gamma voltage to reduce the image sticking of the liquid crystal display panel 110, although the polarities of the on-pixels are equally distributed.

The liquid crystal display device 100 according to example embodiments may prevent or reduce the crosstalk defect by changing the inversion driving method to equally distribute the polarity of the on-pixels and changing the gamma voltages of which the positive gamma voltages and the negative gamma voltages are symmetrically arranged.

Referring to FIG. 2, the timing controller 140 may include a first detector 142, a second detector 144, an inversion driving controller 146, and a gamma controller 148.

The first detector 142 may determine whether the image data RGB includes a set or predetermined crosstalk pattern. Here, the crosstalk pattern is a pattern that causes a crosstalk defect when the crosstalk pattern is displayed on the liquid crystal display panel 110.

The first detector 142 may determine whether the image data RGB includes the crosstalk pattern based on a size, a shape, and a grayscale value of the pattern. In some example embodiments, the first detector 142 may store the crosstalk patterns and determine whether the image data RGB includes the crosstalk pattern by comparing patterns of the image data RGB to the set or predetermined crosstalk pattern. In other example embodiments, the first detector 142 may set a detection condition for detecting the crosstalk pattern and determine whether the image data RGB includes the crosstalk pattern based on the detection condition. For example, the first detector 142 may set an arrangement of the on-pixels, the number of the on-pixels, the polarity of the on-pixels, the grayscale value of the on-pixels, etc. as the detection condition. The first detector 142 may output the image data RGB to the second detector 144 when the image data RGB includes the crosstalk pattern. The first detector 142 may provide the image data RGB to the data driver 130 when the image data RGB does not include the crosstalk pattern. Alternatively, the first detector 142 may provide the image data RGB to a block for performing the display quality compensation, the adaptive color correction (ACC), and/or the dynamic capacitance compensation (DCC) in the timing controller 140.

The second detector 144 may determine whether the polarities of the on-pixels that turn on corresponding to the image data RGB are unequally distributed when the image data RGB includes the crosstalk pattern. The second detector 144 may analyze the image data RGB by every line data. The second detector 144 may determine whether the polarities of the on-pixels are unequally distributed or equally distributed based on the polarities of the on-pixels consecutively arranged in the same line data and the polarities of the on-pixels arranged in the adjacent line data. Further, the second detector 144 may detect a data area in which the polarities of the on-pixels are unequally distributed and provide the data area to the inversion driving controller 146. The second detector 144 may provide the image data RGB and the data area to the inversion driving controller 146 when the polarities of the on-pixels are unequally distributed.

The inversion driving controller 146 may change the inversion driving method of the image data RGB when the polarities of the on-pixels are unequally distributed. In some example embodiments, the inversion driving controller 146 may change the inversion driving method of all of the image data RGB. For example, the inversion driving controller 146 may change the inversion driving method of the image data RGB from 2dot inversion (++−−) driving method to 4dot inversion (++++−−−) driving method. In other example embodiments, the inversion driving controller 146 may change the inversion driving method of the line data that includes the data area provided from the second detector 144. For example, the inversion driving controller 146 may change the inversion driving method of Nth through (N+M) th line data to the 4dot inversion driving method when the 2dot inversion driving method is applied to the image data RGB, where N and M are integer equal or approximate to 1.

The gamma controller 148 may output the gamma control signal that changes the positive gamma voltages and the negative gamma voltage to be symmetric when the polarities of the on-pixels are equally distributed. That is, the gamma controller 148 may output the gamma control signal in a case that the image data RGB, of which the polarities of the on-pixels are equally distributed, is detected and/or in a case that the polarities of the on-pixels are equally distributed in the inversion driving controller 146 by changing the inversion driving method. The gamma controller 148 may output the gamma control signal that changes the reference gamma voltage generated in the power management integration circuit (that is, power controller). The power management integration circuit may generate a power voltage to drive the liquid crystal display device 100 and provide the power voltage to the liquid crystal display panel 110 and the data driver 130. The gamma controller 148 may be coupled to the power management integration circuit. The gamma controller 148 may output the gamma control signal that changes a digital variable resistor included in the power management integration circuit. The power management integration circuit may generate the gamma reference voltages provided to the data driver 130 based on a digital variable resistor value. For example, the power management integration circuit may generate a plurality (e.g., four) of reference voltages and provide the reference voltages to the data driver 130. The timing controller 140 may include a plurality of gamma data sets. Here, the timing controller 140 store the gamma data sets as a lookup table (LUT). The timing controller 140 may provide one of the gamma data sets to the data driver 130 based on the gamma control signal. The data driver 130 may generate gamma voltages of which the positive gamma voltages and the negative gamma voltages are symmetric based on the reference gamma voltages provided from the power management integration circuit and the gamma data set provided form the timing controller 140. The data driver 130 may determine a maximum positive gamma voltage, a minimum positive gamma voltage, a maximum negative gamma voltage, and a minimum negative gamma voltage, based on the reference gamma voltages and determine gamma voltages between the maximum positive gamma voltage and the minimum positive gamma voltage, and gamma voltages between the maximum negative gamma voltage and the minimum negative gamma voltage, based on the gamma data sets. The data driver 130 may provide the gamma voltage corresponding to the image data RGB as the data signal DS (i.e., the data voltage) to the pixels in the liquid crystal display panel 110 through the data line.

As described above, the liquid crystal display device 100 may prevent or reduce the crosstalk defect by determining whether the image data RGB includes the crosstalk pattern, changing the inversion driving method when the image data RGB includes the crosstalk pattern, and generating the gamma voltages of which the positive gamma voltage and the negative gamma voltages are symmetric. Here, the liquid crystal display device 100 may prevent or reduce the sticking image by changing the positive gamma voltages and the negative gamma voltages to be symmetric only in the case the image data RGB includes the crosstalk pattern and maintaining the positive gamma voltages and the negative gamma voltages to be asymmetric in case that the image data RGB does not include the crosstalk pattern.

Figure 4A:
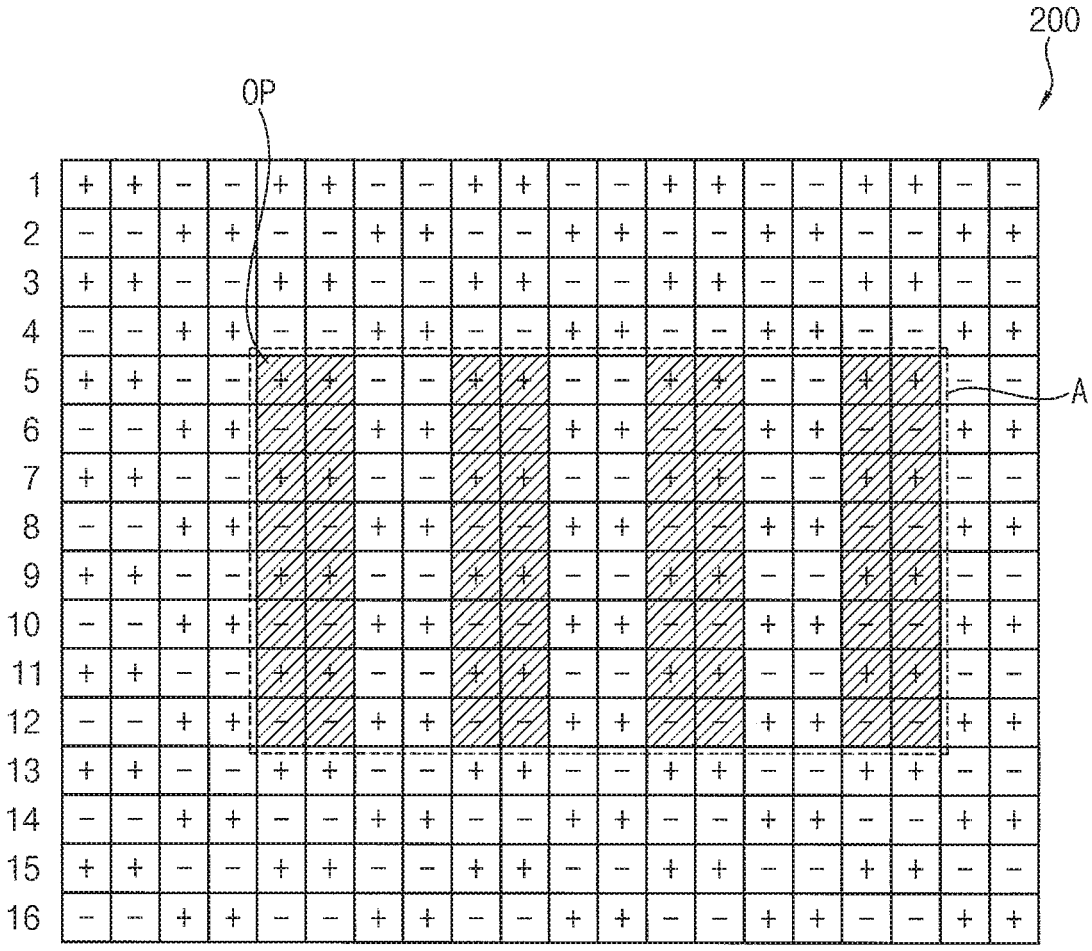
FIGS. 4A and 4B are diagrams illustrating an example operation of a second detector included in the timing controller of FIG. 2.
Figure 4B:
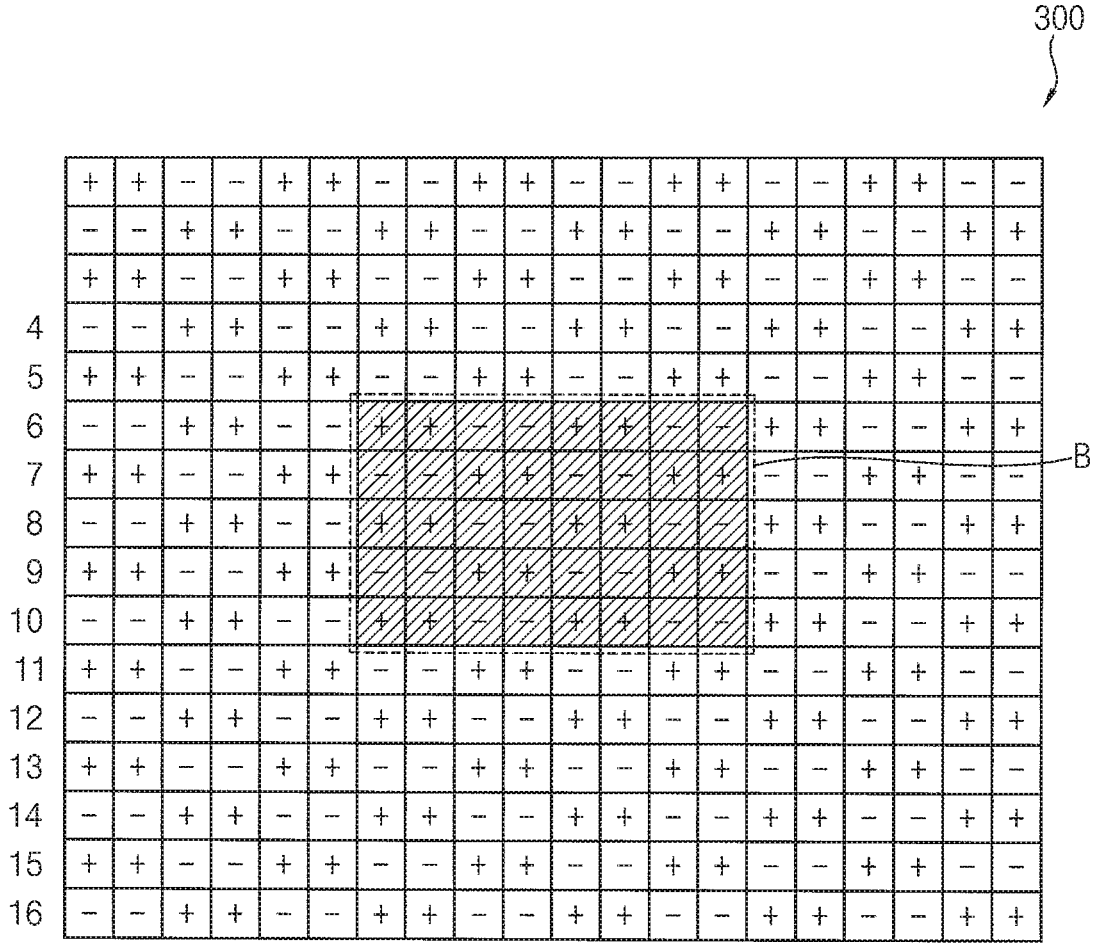

FIGS. 3A and 3B are diagrams illustrating an example operation of a first detector included in the timing controller of FIG. 2, and FIGS. 4A and 4B are diagrams illustrating an example operation of a second detector included in the timing controller of FIG. 2.

FIGS. 3A and 3B are diagrams illustrating an example of the crosstalk pattern CP detected in the first detector. In some example embodiments, the first detector may verify whether the pattern in the image data is matched up with the set or predetermined crosstalk patterns CP and output the image data to the second detector when the pattern in the image data is matched up with the set or predetermined crosstalk pattern CP. In other example embodiments, the first detector may verify whether the pattern in the image data satisfies the set or predetermined detection condition and output the image data to the second detector when the pattern in the image data satisfies the detection condition. Although the crosstalk pattern CP having a low grayscale and a square shape is described in FIGS. 3A and 3B, the crosstalk pattern CP is not limited thereto. For example, the crosstalk pattern has a polygonal shape having the low grayscale and having dots pattern.

The second detector may determine whether the polarities of the on-pixels that turn on corresponding to the image data are unequally distributed. In some example embodiments, the second detector may determine whether the polarities of the on-pixels consecutively arranged in the same line data are unequally distributed. In other example embodiments, the second detector may determine whether the polarities of the on-pixels arranged in an adjacent line data are unequally distributed.

FIG. 4A is a diagram illustrating the polarities of the pixels when the image data of FIG. 3A is displayed on the liquid crystal display panel 200 driven using the 2dot inversion driving method (++−−). Referring to FIG. 4A, the polarities of the on-pixels OP included in the fifth through twelfth rows that include the crosstalk pattern CP are unequally distributed. Specifically, the second detector that analyzes the image data by every line data may determine that the polarities of the on-pixels OP are unequally distributed because only the on-pixels OP having the positive polarity are distributed in the fifth row, the seventh row, the ninth row, and the eleventh row and only the on-pixels OP having the negative polarity are distributed in the sixth row, the eighth row, the tenth row, and the twelfth row. Further, the second detector may detect the data area A in which the polarities of the on-pixels OP are unequally distributed. The second detector may provide the image data and the data area A to the inversion driving controller.

FIG. 4B is a diagram illustrating the polarities of the pixels when the image data of FIG. 3B is displayed on the liquid crystal display panel 300 driven using the 2dot inversion driving method (++−−). Referring to FIG. 4B, the polarities of the on-pixels included in the sixth through tenth rows that include the crosstalk pattern CP are equally distributed. Specifically, the on-pixels OP having the positive polarity and the on-pixels OP having the negative polarity are equally distributed in the sixth through tenth rows. Thus, the second detector may determine that the polarities of the on-pixels OP are equally distributed. The second detector may provide the image data to the gamma controller.

As described above, the polarities of the on-pixels OP are equally or unequally distributed according to the crosstalk pattern CP. The crosstalk defect may be reduced by changing the inversion driving method and the gamma voltages when the polarities of the on-pixels OP are unequally distributed. Further, the crosstalk defect may be further reduced by changing the gamma voltages when the polarities of the on-pixels OP are equally distributed.

Figure 5:
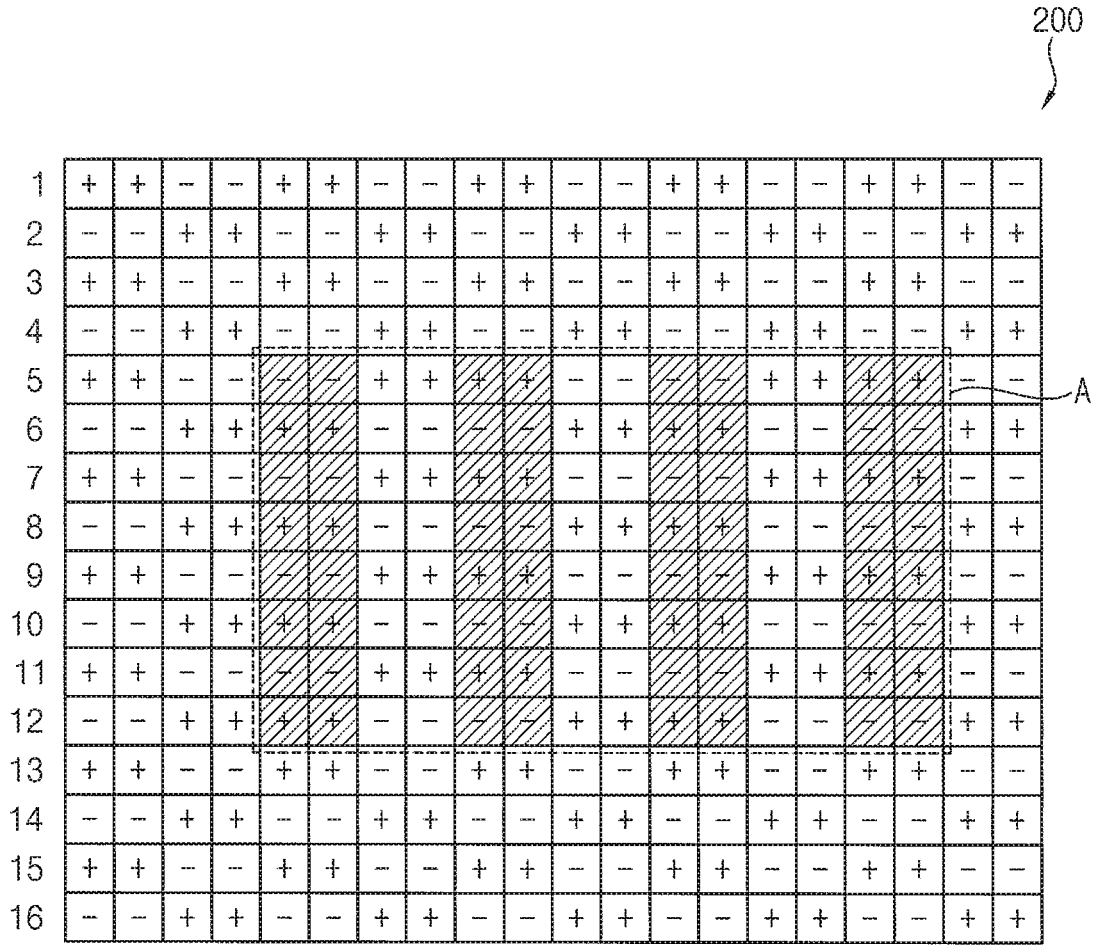
FIG. 5 is a diagram illustrating an example operation of an inversion driving controller included in the timing controller of FIG. 2.

FIG. 5 is a diagram illustrating an example operation of an inversion driving controller included in the timing controller of FIG. 2.

The inversion controller may change the inversion driving method of all of the image data based on the image data and the data area provided from the second detector. Alternatively, the inversion driving controller may change the inversion driving method of line data that includes the data area based on the image data and the data area provided from the second detector.

FIG. 5 is a diagram illustrating an example that changes the polarities of the line data in the fifth through twelfth row that includes the data area A in which the polarities of the on-pixels OP are unequally distributed. The inversion driving controller may determine the inversion driving method by a calculation based on an arrangement of the on-pixels included in the data area A, the number of the polarities of the on-pixels OP, etc. Referring to FIG. 5, the inversion driving controller may change the inversion driving method of the line data in the fifth through twelfth line data from the 2dot inversion driving method (++−−) to the 4dot inversion driving method (++++−−−−). In this case, the on-pixels OP having the positive polarity and the on-pixels OP having the negative polarity in the same data line may be equally distributed.

The inversion driving controller that changes the inversion driving method of the line data that includes the data area A is illustrated in FIG. 5, an operation of the inversion driving controller is not limited thereto. For example, the inversion driving controller may change the inversion driving method of all of the image data. Further, the inversion driving controller that changes the inversion driving method from the 2dot inversion driving method (++−−) to the 4dot inversion driving method (++++−−−−), an operation of the inversion driving controller is not limited thereto. For example, the inversion driving controller may change the inversion driving method from the 2dot inversion driving method (++−−) to a 1 dot inversion driving method (+−) or a line inversion driving method.

As described above, the on-pixels OP having the positive polarity + and the on-pixels OP having the negative polarity, may be equally distributed by changing the inversion driving method in the inversion driving controller. Thus, the crosstalk defect may be prevented or reduced.

Figure 6A:
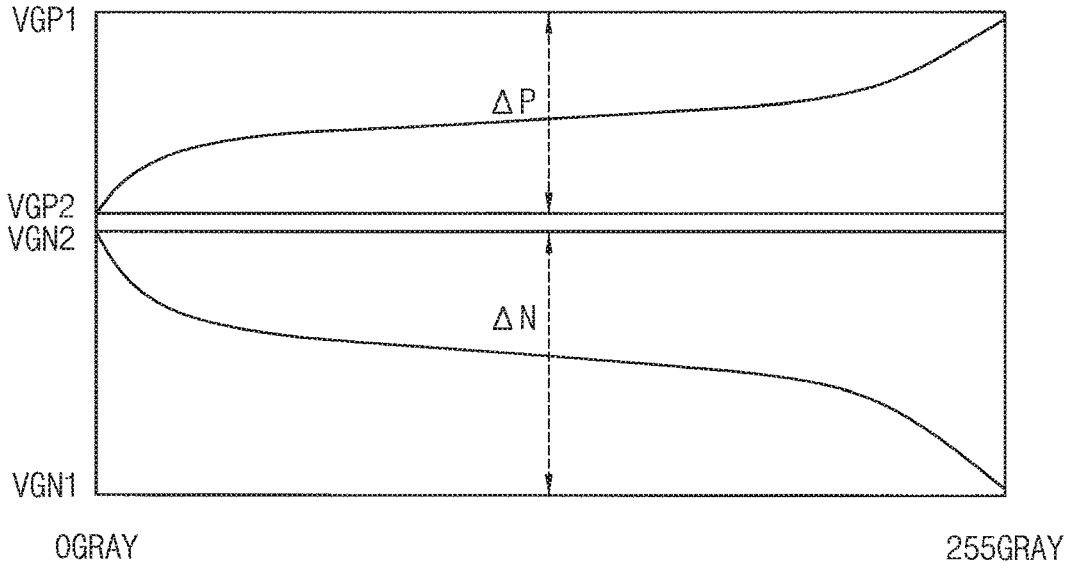
FIGS. 6A through 6C are diagrams illustrating an example operation of a gamma controller included in the timing controller of FIG. 2.
Figure 6B:
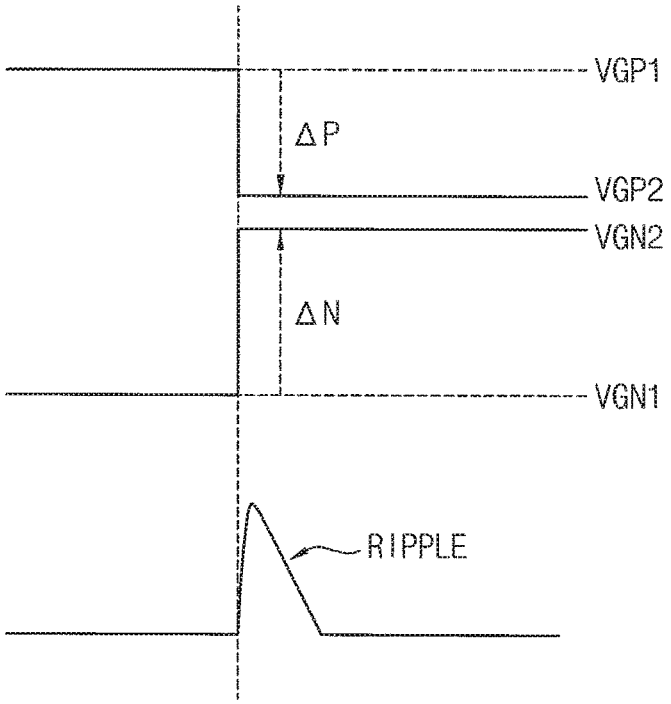
Figure 6C:
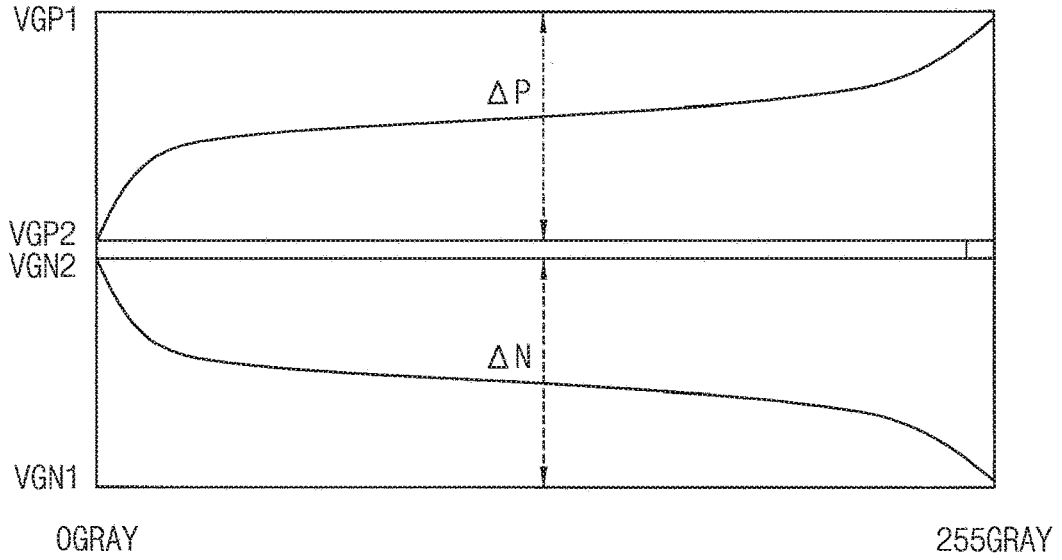

FIGS. 6A through 6C are diagrams illustrating an example operation of a gamma controller included in the timing controller of FIG. 2.

The gamma controller may change the gamma voltages of the image data when the polarities of the on-pixels are equally distributed. Specifically, the gamma controller may change the gamma voltages when the image data, of which the polarities of the on-pixels are equally distributed, is detected in the second detector, or when the polarities of the on-pixels are equally distributed by changing the inversion driving method in the inversion driving controller.

Referring to FIG. 6A, the positive gamma voltage and the negative gamma voltage may be asymmetrically determined considering an amount of kickback voltage to reduce the image sticking. That is, a difference ΔP between the maximum positive gamma voltage VGP1 and the minimum positive gamma voltage VGP2 and a difference ΔN between the minimum negative gamma voltage VGN1 and the maximum negative gamma voltage VGN2 may be different from each other. Referring to FIG. 6B, ripple may occur on a common voltage Vcom when the image data is rapidly changed. Although, the ripple may not be recognized in a general 60 Hz driving method, the crosstalk defect occurred by the ripple of the common voltage Vcom may be recognized in a high frequency driving method.

Referring to FIG. 6C, the gamma controller may output the gamma control signal that changes the gamma voltages to be symmetric to improve the crosstalk defect occurred by the asymmetry of the positive gamma voltage and the negative gamma voltage. The gamma controller may provide the gamma control signal to the power management integrated circuit and the gamma data set selector in the timing controller.

The power management integrated circuit may generate the reference gamma voltage based on the gamma control signal and may provide the reference gamma voltage to the data driver. For example, the power management integrated circuit may provide the positive maximum voltage VGP1, the positive minimum voltage VGP2, the negative minimum voltage VGN1, and the negative maximum voltage VGN2 as the reference gamma voltage.

The timing controller may store the plurality of gamma data sets. The timing controller may output one of the gamma data sets based on the gamma control signal.

The data driver may generate the gamma voltages that in which the positive gamma voltage and the negative gamma voltage are symmetric based on the reference gamma voltage and the gamma data set from the power management integrated circuit. That is, the data driver may reduce the crosstalk defect occurred by the ripple of the common voltage Vcom by generating the gamma voltages of which the difference ΔP between the maximum positive gamma voltage VGP1 and the minimum positive gamma voltage VGP2 and the difference ΔN between the minimum negative gamma voltage VGN1 and the maximum negative gamma voltage VGN2 are the same.

As described above, the gamma controller may improve the crosstalk defect occurred by the ripple of the common voltage Vom by changing the positive gamma voltages and the negative gamma voltages to be symmetric when the image data of which the polarities of the on-pixels are equally distributed.

Figure 7:
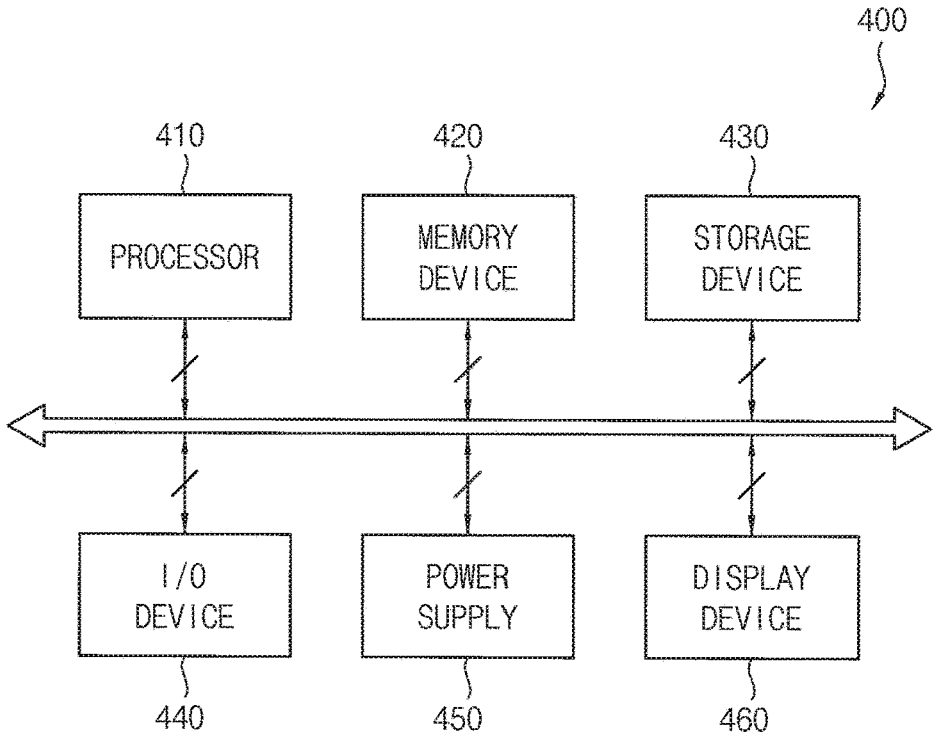
FIG. 7 is a block diagram illustrating an example electronic device that includes the liquid crystal display device of FIG. 1.
Figure 8:
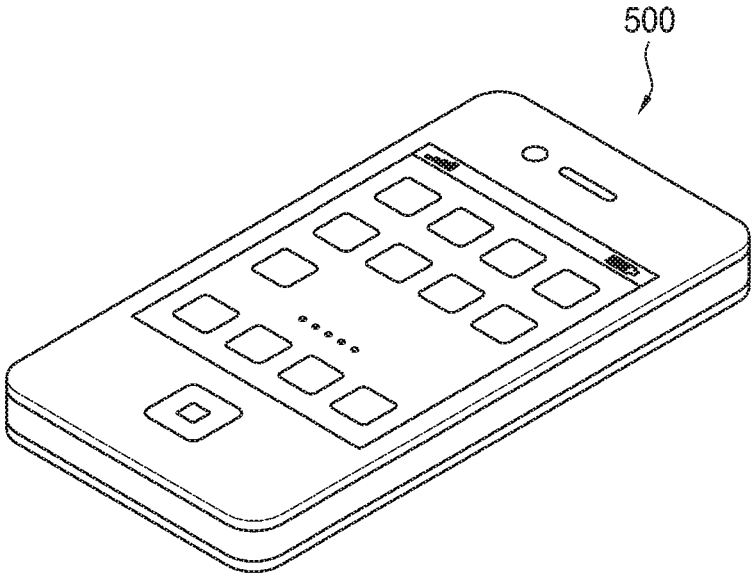
FIG. 8 is a diagram illustrating an example embodiment in which the electronic device of FIG. 7 is implemented as a portable electronic device (e.g., a smart phone).

FIG. 7 is a block diagram illustrating an example electronic device that includes the liquid crystal display device of FIG. 1 and FIG. 8 is a diagram illustrating an example embodiment in which the electronic device of FIG. 7 is implemented as a portable electronic device (e.g., a smart phone).

Referring to FIGS. 7 and 8, an electronic device 400 may include a processor 410, a memory device 420, a storage device 430, an input/output (I/O) device 440, a power device 450, and a display device 460. Here, the display device 460 may correspond to the display device 100 of FIG. 1. In addition, the electronic device 400 may further include a plurality of ports for communicating a video card, a sound card, a memory card, a universal serial bus (USB) device, other electronic device, etc. Although it is illustrated in FIG. 8 that the electronic device 400 is implemented as a portable electronic device (e.g., a smart phone) 500, a kind of the electronic device 400 is not limited thereto.

The processor 410 may perform various computing functions. The processor 410 may be a microprocessor, a central processing unit (CPU), etc. The processor 410 may be coupled to other components via an address bus, a control bus, a data bus, etc. Further, the processor 410 may be coupled to an extended bus such as peripheral component interconnect (PCI) bus. The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 430 may be a solid stage drive (SSD) device, a hard disk drive (HDD) device, a CD-ROM device, etc.

The I/O device 440 may be an input device such as a keyboard, a keypad, a touchpad, a touch-screen, a mouse, etc, and an output device such as a printer, a speaker, etc. In some example embodiments, the display device 460 may be included in the I/O device 440. The power device 450 may provide a power for operations of the electronic device 400. The display device 460 may communicate with other components via the buses or other communication links. As described above, the display device 460 may include a liquid crystal display panel, a gate driver, a data driver, and a timing controller. The liquid crystal display panel may include data lines, gate lines, and a plurality of pixels. The liquid display panel may display an image on the pixels based on a data signal provided through the data lines and a gate signal provided through the gate lines. The timing controller may receive an image data and a control signal from an external device. The timing controller may generate a first control signal and a second control signal provided to the data driver and the gate driver based on the control signal. The timing controller may analyze a pattern of the image data by every frame and change an inversion driving method and gamma voltages of the image data based on a pattern analyzing result of the image data. The timing controller may determine whether the image data includes a set or predetermined crosstalk pattern. The timing controller may determine whether polarities of on-pixels that turn on corresponding to the image data are equally distributed when the image data includes the crosstalk pattern. Here, the timing controller may analyze the polarities of the on-pixels by every line data. The timing controller may change the inversion driving method when the polarities of the on-pixels are unequally distributed. In some example embodiments, the timing controller may change the inversion driving method of all of the image data. In other example embodiment, the timing controller may change the inversion driving method of the line data that includes an area in which the polarities of the on-pixels are unequally distributed. The timing controller may output a gamma control signal that changes a positive gamma voltage and a negative gamma voltage to be symmetric when the polarities of the on-pixels are equally distributed. The power management integrated circuit coupled to the timing controller may generate a reference gamma voltage based on the gamma control signal and output the reference voltage to the data driver. Further, the timing controller may store a plurality of gamma data sets, and output one of the gamma data sets to the data driver based on the gamma control signal. The data driver may generate gamma voltages of which the positive gamma voltage and the negative gamma voltage are asymmetric based on the reference voltage and the gamma data set.

As described above, some example embodiments of the present disclosure may prevent or reduce the crosstalk defect by including the display device 460 that equally distributes the polarities of the on-pixels when the image data includes the crosstalk pattern and changes the positive gamma voltage and the negative gamma voltage to be symmetric.

Figure 9:
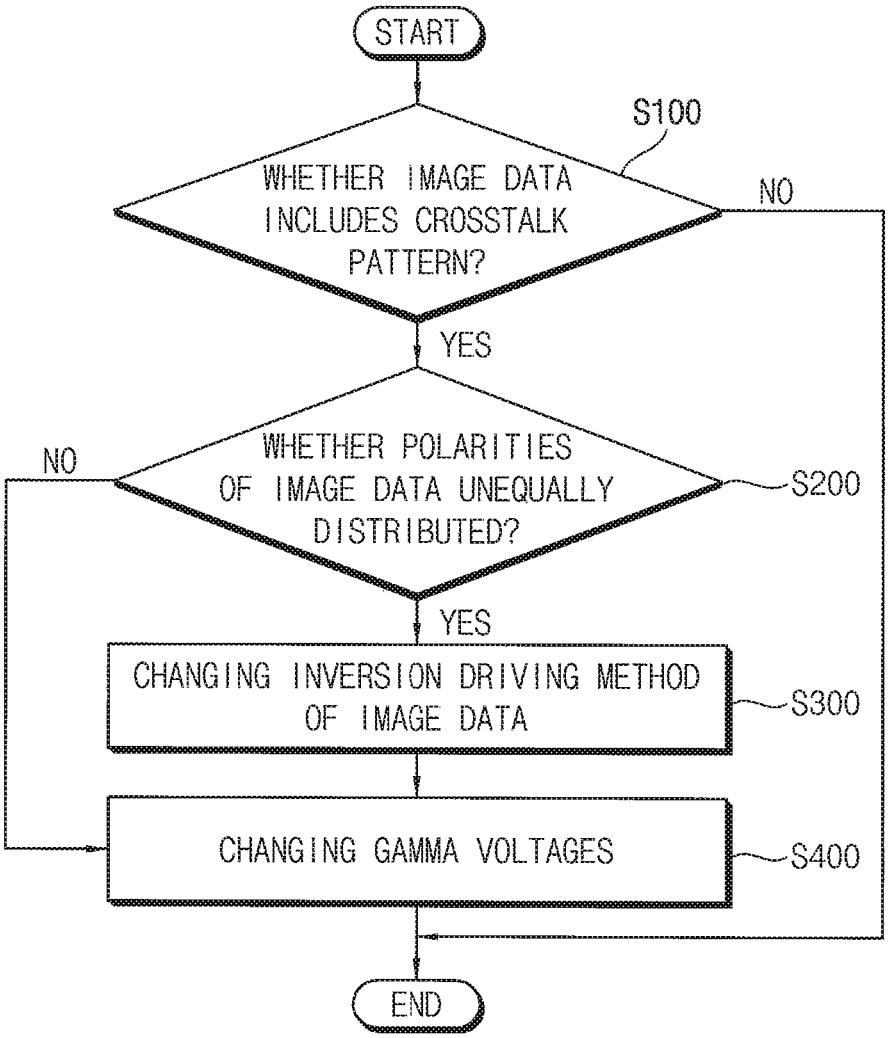
FIG. 9 is a flowchart illustrating a driving method of a liquid crystal display device according to an example embodiment.
Figure 10:
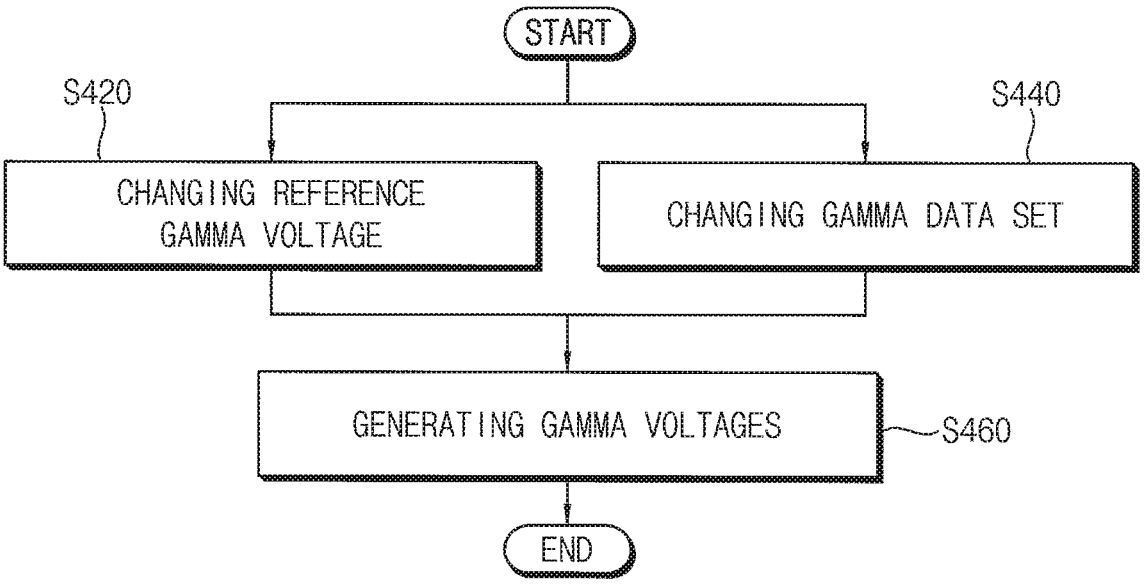
FIG. 10 is a flowchart illustrating a gamma voltage changing method included in the driving method (of the liquid crystal display device) of FIG. 9.

FIG. 9 is a flowchart illustrating a driving method of a liquid crystal display device according to example embodiments and FIG. 10 is a flowchart illustrating a gamma voltage changing method included in the driving method of the liquid crystal display device according to example embodiments.

Referring to FIG. 9, a driving method of a liquid display device may include an act of determining whether an image data includes a crosstalk pattern S100, an act of determining whether polarities of on-pixels that turns on corresponding to the image data are unequally distributed when the image data includes the crosstalk pattern S200, an act of changing an inversion driving method of the image data when the polarities of the on-pixels are unequally distributed S300, and an act of changing gamma voltages of the image data when the polarities of the on-pixels are equally distributed S400.

The driving method of the liquid crystal display device may determine whether the image data includes the crosstalk pattern S100. The driving method of the liquid crystal display device may determine whether the image data includes the crosstalk pattern based on a size, a shape, and a grayscale value of the pattern. In some example embodiments, the driving method of the liquid crystal display device may determine whether the image data includes the crosstalk pattern by comparing patterns in the image data to set or predetermined crosstalk pattern. In other example embodiments, the driving method of the liquid crystal display device may set a detection condition for detecting the crosstalk pattern and determine whether the image data RGB includes the crosstalk pattern based on the detection condition. The driving method of the liquid crystal display device may perform the step of determine whether the polarities of the on-pixels are unequally distributed when the image data includes the crosstalk pattern S200. The driving method of the liquid crystal display device may finish the driving method for improving the crosstalk defect when the image data does not include the crosstalk pattern.

The driving method of the liquid crystal display device may determine whether the polarities of the on-pixels that turn on corresponding to the image data are unequally distributed when the image data includes the crosstalk pattern S200. The driving method of the liquid crystal display device may analyze the image data by every line data. The driving method of the liquid crystal display device may determine whether the polarities of the on-pixels are unequally distributed or equally distributed based on the polarities of the on-pixels consecutively arranged in the same line data and the polarities of the on-pixels arranged in the adjacent line data. The driving method of the liquid crystal display device may further include an act of detecting a data area in which the polarities of the on-pixels are unequally distributed. The driving method of the liquid crystal display device may perform the step of changing the inversion driving method of the image data when the polarities of the on-pixels are unequally distributed S300. The driving method of the liquid crystal display device may perform the step of changing the gamma voltages of the image data when the polarities of the on-pixels are equally distributed S400.

The driving method of the liquid crystal display device may change the inversion driving method of the image data when the polarities of the on-pixels are unequally distributed S300. In some example embodiments, the driving method of the liquid crystal display device may equally distribute the polarities of the on-pixels by changing the inversion driving method. In other example embodiments, the driving method of the liquid crystal display device may change the inversion driving method of the line data that includes the data area detected in the step of determining whether the polarities of the on-pixels are unequally distributed S200. Thus, the polarities of the on-pixels may be equally distributed.

Next, the driving method of the liquid crystal display device may change the gamma voltages of the image data S400. The driving method of the liquid crystal display device may change the gamma voltages when the polarities of the on-pixels are equally distributed. Specifically, the driving method of the liquid crystal display device may change the gamma voltage of which positive gamma voltages and negative gamma voltages to be symmetric when the polarities of the on-pixels are equally distributed. The driving method of the liquid crystal display device may change reference gamma voltage S420 and change gamma data set S440 when the polarities of the on-pixels are equally distributed. The driving method of the liquid crystal display device may generate the gamma voltages of which the positive gamma voltages and the negative gamma voltages are symmetric based on the reference gamma voltage and the gamma data set S460.

As described above, the driving method of the liquid crystal display device of FIG. 10 may reduce the crosstalk defect by changing the polarities of the on-pixels to be equally distributed and changing the gamma voltages of which the positive gamma voltages and the negative gamma voltages are symmetric when the polarities of the on-pixels are equally distributed.

The some example embodiments of the present disclosure may be applied to a display device and an electronic device having the display device. For example, the some example embodiments of the present disclosure may be applied to a computer monitor, a laptop, a digital camera, a cellular phone, a portable electronic device (e.g., a smart phone), a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a liquid crystal display device and a driving method of the same have been specifically described and illustrated herein, many modifications and variations will be apparent to those skilled in the art. Accordingly, it is to be understood that a liquid crystal display device and a driving method of the same constructed according to principles of this invention may be embodied other than as specifically described herein. The invention is also defined in the following claims, and equivalents thereof.

What is claimed is:

1. A liquid crystal display device comprising:

a display panel comprising a plurality of gate lines, a plurality of data lines crossing the gate lines, and a plurality of pixels coupled to the gate lines and the data lines;

a gate driver configured to provide a gate signal to the pixels through the gate lines;

a data driver configured to provide a data signal to the pixels through the data lines; and a timing controller configured to receive an image data, comprising a set or predetermined crosstalk pattern, provided from an external device and generate control signals that control the gate driver and the data driver, wherein the timing controller is configured to analyze a pattern of the image data by every frame, and change an inversion driving method and gamma voltages of the image data based on a pattern analyzing result from the analysis of the pattern of the image data, the pattern comprising the set or predetermined crosstalk pattern, and wherein the timing controller is further configured to change the inversion driving method of the image data, based on a determination that polarities of on-pixels that turn on corresponding to the image data are unequally distributed, based on a determination that the image data comprises the crosstalk pattern, to prevent crosstalk defect.

2. A liquid crystal display device comprising:

a display panel comprising a plurality of gate lines, a plurality of data lines crossing the gate lines, and a plurality of pixels coupled to the gate lines and the data lines;

a gate driver configured to provide a gate signal to the pixels through the gate lines;

a data driver configured to provide a data signal to the pixels through the data lines; and a timing controller configured to receive an image data provided from an external device and generate control signals that control the gate driver and the data driver, wherein the timing controller is configured to analyze a pattern of the image data by every frame, and change an inversion driving method and gamma voltages of the image data based on a pattern analyzing result from the analysis of the pattern of the image data, wherein the timing controller comprises:

a first detector configured to determine whether the image data comprises a set or predetermined crosstalk pattern;

a second detector configured to determine whether polarities of on-pixels that turn on corresponding to the image data are unequally distributed when the image data comprises the crosstalk pattern;

an inversion driving controller configured to change the inversion driving method of the image data when the polarities of the on-pixels are unequally distributed; and a gamma controller configured to output a gamma control signal that symmetrically changes positive gamma voltages and negative gamma voltages generated from the data driver when the polarities of the on-pixels are equally distributed.

3. The liquid crystal display device of claim 2, wherein the first detector is configured to determine whether the image data comprises the crosstalk pattern based on a size, a shape, and a grayscale value of the pattern of the image data.

4. The liquid crystal display device of claim 2, wherein the second detector is configured to analyze the image data by every line data.

5. The liquid crystal display device of claim 4, wherein the second detector is configured to detect a data area in which the polarities are unequally distributed and provide the data area to the inversion driving controller, and wherein the inversion driving controller is configured to change the inversion driving method of the line data that comprises the data area.

6. The liquid crystal display device of claim 2, further comprising:

a power controller configured to generate a voltage provided to the display panel and the data driver, wherein the gamma controller is coupled to the power controller, and configured to output the gamma control signal that changes a reference gamma voltage generated from the power controller.

7. The liquid crystal display device of claim 6, wherein the power controller comprises a digital variable resistor, the power controller configured to change the reference gamma voltage by changing a resistor value of the digital variable resistor based on the gamma control signal.

8. The liquid crystal display device of claim 6, wherein the data driver configured to generate the positive gamma voltages and the negative gamma voltages that are symmetric based on the reference gamma voltage.

9. The liquid crystal display device of claim 2, wherein the timing controller comprises a plurality of gamma data sets that determines a gamma voltage of the data driver, and wherein the gamma controller is configured to output a gamma control signal that changes the gamma data set provided to the data driver.

10. The liquid crystal display device of claim 9, wherein the timing controller is configured to store the gamma data sets as a lookup table (LUT).

11. The liquid crystal display device of claim 9, wherein the data driver is configured to generate the positive gamma voltages and the negative gamma voltages that are symmetric based on the gamma data set.

12. The liquid crystal display device of claim 2, wherein the crosstalk pattern is a pattern that causes a crosstalk defect when the crosstalk pattern is displayed on the display panel.

13. A driving method of a liquid crystal display device comprising:

determining whether an image data provided from an external device comprises a set or predetermined crosstalk pattern;

determining whether polarities of on-pixels that turn on corresponding to the image data are unequally distributed when the image data comprises the crosstalk pattern;

changing an inversion driving method of the image data when the polarities of the on-pixels are unequally distributed; and changing gamma voltages of the image data when the polarities of the on-pixels are equally distributed.

14. The driving method of claim 13, wherein the crosstalk pattern is determined based on a size, a shape, and a grayscale value of pattern of the image data.

15. The driving method of claim 13, wherein the image data is analyzed by every line data.

16. The driving method of claim 15, wherein a distribution of the polarities of the on-pixels is determined by detecting a data area in which the polarities of the on-pixels are unequally distributed, and wherein the inversion driving method of the image data is changed by changing the inversion driving method of the line data that comprises the data area that is changed.

17. The driving method of claim 13, wherein the inversion driving method of the image data is changed by changing the inversion driving method of all image data.

18. The driving method of claim 13, wherein the gamma voltages of the image data are changed by changing a reference gamma voltage.

19. The driving method of claim 13, wherein the gamma voltages of the image data are changed by changing a gamma data set.

20. The driving method of claim 13, further comprising:

generating the gamma voltages of which positive gamma voltages and negative gamma voltages are symmetric.

* * * * *